US009322290B2

(12) United States Patent
Schulze

(10) Patent No.: US 9,322,290 B2
(45) Date of Patent: Apr. 26, 2016

(54) PROPELLER NOZZLE

(75) Inventor: Reinhard Schulze, Panketal (DE)

(73) Assignee: BECKER MARINE SYSTEMS GMBH & CO. KG, Hamburg (DE)

( * ) Notice: Subject to any disclaimer, the term of this patent is extended or adjusted under 35 U.S.C. 154(b) by 778 days.

(21) Appl. No.: 13/613,966

(22) Filed: Sep. 13, 2012

(65) Prior Publication Data

US 2013/0064652 A1 Mar. 14, 2013

(30) Foreign Application Priority Data

Sep. 14, 2011 (DE) ..... 10 2011 053 619

(51) Int. Cl.

| | |
|---|---|
| ***B63H 5/14*** | (2006.01) |
| ***B63H 5/15*** | (2006.01) |
| ***F01D 11/08*** | (2006.01) |
| ***F01D 25/00*** | (2006.01) |

(52) U.S. Cl.

CPC . *F01D 25/00* (2013.01); *B63H 5/14* (2013.01)

(58) Field of Classification Search

CPC ..... B63H 5/14; B63H 5/15; B63H 5/16; B63H 5/165

See application file for complete search history.

(56) References Cited

U.S. PATENT DOCUMENTS

| | | | | |
|---|---|---|---|---|
| 1,600,654 | A * | 9/1926 | Stodder | 416/140 |
| 2,139,594 | A * | 12/1938 | Kort | 114/166 |
| 2,382,535 | A * | 8/1945 | Bauer | 416/147 |
| 2,393,933 | A * | 1/1946 | Poole | 415/58.5 |
| 2,566,525 | A * | 9/1951 | Kort | 239/571 |
| 2,808,227 | A * | 10/1957 | Danel | 415/119 |
| 3,179,081 | A * | 4/1965 | Backhaus et al. | 440/5 |
| 3,386,155 | A * | 6/1968 | Jenkinson | 29/889.1 |
| 3,575,523 | A * | 4/1971 | Gross, Jr. | 415/171.1 |
| 3,677,660 | A | 7/1972 | Taniguchi et al. | |
| 3,680,977 | A | 8/1972 | Rabouyt et al. | |
| 4,065,460 | A | 12/1977 | Heymes et al. | |
| 4,074,652 | A | 2/1978 | Jackson | |
| 4,453,887 | A * | 6/1984 | Schucker | 415/119 |

(Continued)

FOREIGN PATENT DOCUMENTS

| | | | |
|---|---|---|---|
| DE | 2916287 | A1 | 10/1980 |
| DE | 102010029430 | A1 | 8/2011 |

(Continued)

*Primary Examiner* — Richard Edgar
*Assistant Examiner* — Brian O Peters
(74) *Attorney, Agent, or Firm* — Kelly & Kelley, LLP

(57) ABSTRACT

A propeller nozzle for watercraft, includes a nozzle and a propeller having at least one propeller blade which can rotate about a propeller axis and which spans a propeller area through rotation about the propeller axis. The propeller blade has a propeller blade end region wherein the propeller is disposed inside the nozzle in such a manner that a circumferential gap in the circumferential direction of the propeller nozzle is formed between the propeller end region and the inner wall of the nozzle. A marginal flow running from a nozzle in the area of the inner wall of the nozzle can flow through the gap, wherein the performance losses which occur due to turbulence of the marginal flow during flow around the propeller blade end region are kept as low as possible. Flow guiding apparatus guides at least one part of the marginal flow onto the propeller area.

11 Claims, 12 Drawing Sheets

(56) References Cited

U.S. PATENT DOCUMENTS

| | | | | |
|---|---|---|---|---|
| 4,509,925 | A * | 4/1985 | Wuhrer | 440/67 |
| 4,643,844 | A | 2/1987 | Broekhof et al. | |
| 4,844,692 | A * | 7/1989 | Minkkinen et al. | 415/208.1 |
| 5,607,329 | A * | 3/1997 | Cho et al. | 440/6 |
| 5,702,273 | A * | 12/1997 | Cho et al. | 440/6 |
| 5,722,866 | A * | 3/1998 | Brandt | 440/67 |
| 5,947,679 | A * | 9/1999 | Cybularz et al. | 415/17 |
| 6,254,339 | B1 * | 7/2001 | Fisher et al. | 415/173.1 |
| 7,357,687 | B1 | 4/2008 | Gornstein et al. | |
| 8,246,401 | B2 * | 8/2012 | Kluge | 440/67 |
| 9,011,088 | B2 | 4/2015 | Lehmann | |
| 9,062,558 | B2 * | 6/2015 | Joe et al. | |

FOREIGN PATENT DOCUMENTS

| | | | |
|---|---|---|---|
| FR | 2439869 | A1 | 5/1980 |
| GB | 2034435 | A | 6/1980 |
| JP | 50-22470 | B | 7/1975 |
| JP | 55-60699 | A | 5/1980 |
| JP | 58-218496 | A | 12/1983 |
| JP | S59-031514 | Y2 | 9/1984 |
| JP | H3-13111 | B2 | 2/1991 |
| JP | H7-108991 | A | 11/1995 |
| WO | 2011/101489 | A1 | 8/2011 |

* cited by examiner

PROPELLER NOZZLE

The present invention relates to a propeller nozzle, in particular for watercraft such as, for example, ships.

Drive units of watercraft, in particular of ships, comprising a propeller which is surrounded or ensheathed by a nozzle ring or a nozzle are designated as propeller nozzles. Some embodiments of such nozzle rings or nozzles are also called "Kort nozzles". In Kort nozzles, the propeller disposed in the interior of the nozzle is normally configured to be fixed, i.e. the propeller can only be rotated about the drive or propeller axis. For this purpose the propeller is connected to the hull by means of a rotatable but not pivotable propeller shaft mounted to run rigidly along the propeller axis. The propeller shaft is driven by means of a drive disposed in the hull. The propeller is therefore not pivotable (horizontally or vertically) but rotatable about its axis.

In fixed Kort nozzles the nozzle surrounding the propeller is also fixed, i.e. not pivotable and has the central function of increasing the thrust of the drive. In this respect these Kort nozzles are frequently used in tugs, supply ships etc. which must each apply a high thrust. In such fixed Kort nozzles, an additional manoeuvring arrangement, in particular a rudder, must be disposed in the propeller backwash, i.e. downstream of the propeller nozzle when viewed in the direction of travel of the ship, for controlling the ship or the watercraft.

In contrast to this, in pivotable or controllable Kort nozzles the nozzle is configured to be pivotable about the fixed propeller. By this means, not only the thrust of the watercraft is increased but at the same time also the Kort nozzle is used to control the watercraft. As a result, auxiliary manoeuvring systems such as rudders can be replaced or made superfluous. Due to the pivoting of the nozzle about the pivot axis, which normally runs vertically when installed, the direction of the total thrust vector (this is composed of propeller backwash and nozzle thrust vector) can be changed and the watercraft can thus be controlled.

Therefore pivotable or controllable propeller nozzles are also designated as "rudder nozzles". In the present case, the term "pivotable" is to be understood such that the nozzle can be swivelled by a predefined angle from its initial position both to starboard and to port. Controllable Kort nozzles are usually not rotatable by a full 360°.

Another variant of propeller nozzles configured as rudder nozzles are those rudder nozzles in which the nozzle is fixed relative to the propeller but the entire rudder nozzle, including nozzle and propeller, can be swivelled by 360°. Such propeller nozzles are also in some cases designated as nozzle-enclosed rudder propellers.

The nozzle or Kort nozzle in this case is normally an externally approximately conically tapering, preferably rotationally symmetrically configured pipe, which forms the wall of the propeller nozzle. As a result of the tapering of the pipe towards the stern of the ship, the propeller nozzles can transmit an additional thrust to the watercraft without the working capacity needing to be increased. Along with the propulsion-improving properties, pitching in swell is further reduced by this means so that the losses of speed in heavy seas can be reduced and the course stability can be increased. Since the inherent resistance of the propeller nozzle or a Kort nozzle increases approximately quadratically with increasing ship's speed, their advantages are particularly effective for slow ships which must produce a large propeller thrust (e.g. tugs, fishing vessels etc.).

The propellers disposed inside the propeller nozzle comprise at least one, preferably a plurality of propeller blades (e.g. 3, 4 or 5 blades). The individual propeller blades project radially outwards from the propeller hub lying on the propeller shaft and are usually each shaped the same and distributed at regular intervals around the propeller hub. As a result of the rotation about the propeller shaft, the propeller blades span a propeller area. This applies both for single-start screws, i.e. propeller nozzles having only one propeller blade and also for variants having a plurality of propeller blades, where the plurality of propeller blades then together span the propeller area. When the propeller is viewed from above, this is usually a circular surface, where the outer edge of the circular surface in each cases bears against the propeller blade end regions or outer propeller blade tips and its centre point lies on the propeller shaft. The propeller blade end regions accordingly form the free end of each propeller blade which, when viewed in the radial direction is that part of the propeller blade at the greatest distance from the propeller hub.

For safe functioning of the propeller nozzle, it is absolutely essential that a gap or spacing is left between the propeller blade end regions, i.e. the outer propeller blade tip, and the inner side or inner wall of the nozzle. Leaving such a minimum gap ensures that the individual propeller blades can rotate unimpeded and no collisions occur as a result of vibrations.

A propeller nozzle has both a flow inlet region and a flow outlet region which together specify a direction of flow through which the water flows through the nozzle of the propeller nozzle when the (water)craft is travelling forwards. The water flowing along in the inner marginal region of the nozzle, i.e. in the region of the inner wall of the nozzle, that flows through the gap between propeller blade end regions and inner wall of the nozzle in the course of a flow path through the gap between propeller blade end regions is designated in the present case as marginal flow. Since the gap must be formed circumferentially around the propeller in order to ensure a functioning of the propeller nozzle, the marginal flow is also disposed distributed circumferentially around the entire inner jacket of the nozzle.

It is generally known that in propellers of propeller nozzles turbulence forms in particular in the region of the propeller blade end regions. This turbulence lies in the marginal flow described above. Circulation losses which reduce the performance of the propeller nozzle occur due to this turbulence. It fundamentally applies that the larger the gap, the stronger the circulation losses which occur. Accordingly, the gap sizes, i.e. the distance from propeller blade end region to the inner wall of the nozzle are dimensioned to be as small as possible, where a minimum gap size which depends on the dimensions of the particular propeller nozzle should be adhered to for safety reasons.

It is the object of the present invention to provide a propeller nozzle in which the losses of performance caused by turbulences of the marginal flow during flow around the propeller blade end regions are kept as low as possible.

This object is solved according to the present invention in that flow guiding means for guiding at least a part of the marginal flow onto the propeller area are provided on the propeller nozzle.

The flow guiding means are configured in such a manner that they deflect at least a part of the marginal flow away from the normal flow path from the gap and onto the propeller area. In other words, the flow means can guide at least a part of the marginal flow away from the region of the inner wall of the nozzle and onto the propeller surface. By this means it is achieved that a part of the marginal flow which normally flows around the propeller blade end regions is instead guided onto the propeller area where it is grasped by the propeller blades and flows out from the propeller nozzle again as propeller nozzle backwash and thereby reduces the formation of turbulence in the propeller nozzle. Accordingly, the flow guiding means are configured in such a manner that they deflect at least a part of the marginal flow from its normal flow path along the inner wall of the nozzle and guide it onto the propeller area, i.e. the propeller itself. In other words, at least a part of the marginal flow is deflected by the flow guiding means from the marginal or nozzle inner wall region. Overall the flow rate of the marginal flow flowing through the gap is reduced by this means. This leads to reduced turbulence in the region downstream of the propeller blade end region when viewed in the direction of flow and as a result leads to an improvement in the overall performance of the propeller nozzle. The flow guiding means therefore reduces the amount of water flowing through the gap between propeller blade end region and nozzle inner wall in a defined time interval.

The flow guiding means can have any structural configuration which is suitable for deflecting a part of the marginal flow away from the normal flow path from the gap and onto the propeller blade end region surface. In particular, the flow guiding means are preferably formed by a suitable configuration of the contour of the nozzle inner wall.

The flow guiding means are expediently configured in such a manner that they guide a reasonable proportion of the marginal flow, for example, more than half, more than 60% or more than 75% of the marginal flow onto the propeller surface.

The flow guiding means usually do not influence the dimensions of the gap or the gap size. In particular, in the present invention the gap expediently always has at least the minimum gap dimension required for the respective size of the propeller nozzle. In particular, the gap has a thickness, i.e. a distance between propeller blade end region and inner wall of the nozzle, of 1% to 2% of the propeller diameter, preferably of 1.2% to 1.8%. Since the individual propeller blades are usually inclined with respect to the direction of flow of the propeller nozzle, the gap runs in the direction of flow over the entire depth of the inclined propeller blade.

The present propeller nozzle according to the invention can be designed both as a controllable variant (rudder nozzle) and as a fixed variant with fixed, non-swivellable nozzle. The controllable propeller nozzle can be configured, for example, as a controllable Kort nozzle or as a rudder nozzle which can be pivoted by 360°. The advantages according to the invention of the lower circulation losses are obtained in both variants. In the propeller nozzle according to the invention, the propeller is preferably arranged between the centre of the nozzle and the flow outlet region of the nozzle when viewed in the direction of flow. An arrangement of the propeller between 50% and 70% of the nozzle length relative to the inlet edge of the nozzle in the flow inlet region is particularly preferred. In particular, in rotationally symmetrical nozzles, the propeller is disposed with its propeller axis concentrically to the nozzle axis so that a circumferential gap of constant width is obtained.

The present invention can be applied both to propeller nozzles having fixed propeller blades and also to those having adjustable propeller blades.

It is further preferred that the propeller nozzle is used in watercraft, for example, ships. In principle, however, the propeller nozzle according to the invention is not restricted to this application and other areas of application such as, for example, in air travel are also possible.

The propeller nozzle has at least one propeller blade. In principle, however, variants with several propeller blades, for example with 3, 4 or 5 propeller blades, are preferred.

In some embodiments the flow guiding means are configured in such a manner that they either guide the marginal flow away from the inner wall of the nozzle in the direction of the nozzle centre and therefore onto the propeller area or that they allow the propeller area to be inserted or introduced into the region of the marginal flow. In the last-mentioned alternative, the flow guiding means enable the propeller blade end regions to be extended further outwards compared with the propeller nozzles of the same dimensions known from the prior art, i.e. to use a larger propeller (diameter). By shifting the propeller or the propeller surface further outwards, a part of the marginal flow that would normally flow through the gap in propeller nozzles known from the prior art is guided into the propeller surface without the marginal flow needing to be deflected from its normal flow path or its normal flow track. Furthermore the performance of the propeller nozzle is further increased by enlarging the propeller. The deflection of the flow from the inner wall of the nozzle by the flow guiding means according to the first previously described alternative should be understood in such a manner that the flow is in particular deflected obliquely away from the edge.

In a preferred embodiment of the invention the flow guiding means are disposed in the region of the propeller blade end regions or in the immediate vicinity of the gap or the propeller blade end regions. The term "immediate vicinity of the gap" is understood in the present case in such a manner that the flow guiding means can be disposed in the gap, in the direction of flow upstream of the gap and/or in the direction of flow downstream of the gap. That is, the flow guiding means can fundamentally extend from a position immediately or directly upstream of the gap, through the gap as far as a position directly or immediately downstream of the gap. If the flow means are disposed upstream and/or downstream of the gap, they should be arranged in such a manner adjacently or in such a spacing that they can influence the marginal flow in such a manner that they are guided at least partially onto the propeller area.

Since the flow means are configured for guiding the marginal flow which flows along the inner wall of the nozzle, it is expedient to also arrange or configure the flow guiding means on the inner wall of the nozzle. The flow guiding means can in principle be attached as separate components to the inner wall of the nozzle or they can be formed in the wall or inner wall of the nozzle (in one piece).

In principle, the flow guiding means can be disposed only in one region or several separate regions of the nozzle when viewed in the circumferential direction of the nozzle. It is preferred however that the flow guiding means are configured circumferentially in the sense of a ring in the circumferential direction of the nozzle. It is thereby ensured that the entire marginal flow in each region of the nozzle is influenced by flow guiding means. As a result, the performance of the propeller nozzle is further improved. Alternatively to the circumferential arrangement of the flow guiding means, these can be formed, in particular in controllable propeller nozzles, only in the two stern-side or starboard-side lateral regions of the propeller nozzle, since the gap is enlarged in these regions by the swivelling of the propeller axis and thus intensified turbulence can occur there.

In a further preferred embodiment, the flow guiding means comprise one or more recesses in the inner wall or the wall of the nozzle. In the present context, the term "recess" should be understood as a tapering of the nozzle directed into the interior of the nozzle jacket or the nozzle wall in a longitudinal sectional view or a reduction in the nozzle thickness which deviates from the profile behaviour of usual nozzles. When viewed in a longitudinal section of the propeller nozzle, the thickness of the nozzle or the nozzle jacket is therefore reduced in the region of the recess by a larger factor than immediately before and/or after said recess. In particular, the profile thickness of the nozzle in the region of the recess can be reduced compared to the profile thickness of a nozzle having the same dimensions without a recess by 2% to 50% of the profile nozzle thickness, preferably by 3 to 25%, particularly preferably by 5% to 15%.

In a longitudinal sectional view, the length of the recess can be between 5% and 50%, preferably between 10% and 40%, particularly preferably between 20% and 30% of the total length of the nozzle.

The recess can be formed only in certain sections or circumferentially when viewed in the circumferential direction of the nozzle. As a result of the formation of a recess in the nozzle, it is possible to form the propeller to be enlarged in the region of the recess or shortly downstream thereof when viewed in the direction of flow. A large proportion of the marginal flow arriving in the region of the recess will not follow the profile behaviour of the nozzle in the region of the recess but will instead further follow its normal straight flow path and thus become detached from the nozzle edge in the region of the recess. As a result of the enlarged formation of the propeller in the region of the recess, the propeller area is thus introduced into the region of the marginal flow which then flows straight onto the propeller area or is grasped by the propeller blades at least in part, instead of flowing through the now outwardly shifted gap. Here care should be taken to ensure that even when the propeller is enlarged or the propeller blade end regions are introduced into the region of the recess, the minimum distance between propeller blade end regions and nozzle inner wall required in each case is ensured. The recess is expediently disposed directly upstream of or in the region of the propeller blade end regions or the gap.

As a result of the recess, the inner wall of the nozzle in the region of the recess runs relatively rapidly outwards in relation to the nozzle in a profile view. That is, the profile thickness of the nozzle is reduced relatively rapidly in the region of the recess. It is thereby achieved that only a part of the marginal flow follows this inwardly directed profile and consequently the flow rate in the region of the gap is significantly reduced. Overall a sealing effect of the marginal region of the nozzle or the gap is thus obtained as a result of the recess. Furthermore, compared with the prior art, it is furthermore possible to use a propeller having a somewhat larger diameter with the result that the performance of the propeller nozzle is further improved.

In principle, the recess can have any shape as long as the nozzle profile is thereby reduced in the region of the recess. The recess preferably has a step-shaped profile, a sloping profile or a curved profile in a longitudinal sectional view of the nozzle. In particular, in pivotably configured propeller nozzles or when using adjusting propellers, the formation of the recess with curved profile line can be appropriate since the profile of the recess can be adapted to the pivoting path of the nozzle in such a manner that the distance between nozzle inner wall and propeller blade end region remains as constant (small) as possible, at least up to a certain pivot angle.

When viewed in the flow direction of the nozzle downstream of the gap or downstream of the propeller blade end region, the recess can again go over into the normal profile behaviour of the nozzle or run further in another manner, for example, rectilinearly towards the nozzle end. If the nozzle profile is enlarged again downstream of the gap or the propeller blade end regions when viewed in the direction of flow, i.e. the nozzle wall thickness increases again or the nozzle inside diameter decreases, the recess is configured as an indentation. The formation of such an indentation is particularly advantageous in the case of swivellable propeller nozzles, since the gap is kept as small as possible by this means in each of the two pivoting directions. This applies to those pivot angles in which the propeller blade end region is still located in the region of the indentation. An improved sealing effect is also produced by the indentation since the indentation seals the gap region in the sense of a labyrinth seal and only an extremely small amount of flow flows through the gap. This sealing effect is particularly intensified when the propeller is configured and arranged in such a manner that only the minimum distance exists between propeller blade end region and inner wall (at the lowest point of the indentation), i.e. the propeller blade end region is introduced into the region of the indentation. Furthermore, the indentation has the result that compared to the propeller nozzle according to the prior art, the profile of the nozzle wall is only narrower in certain areas and consequently no weakening or only a slight weakening of the nozzle structure occurs. When viewed in the circumferential direction of the nozzle, the indentation can be formed in certain areas or circumferentially, with a type of closed or circumferential annular groove being formed with a circumferential configuration.

The profile of the indentation preferably runs as a circular arc having the same curvature in a longitudinal sectional view of the nozzle. The curvature should advantageously be matched to the swivelling of the nozzle in such a manner that the gap or distance between propeller blade end region and inner wall is always substantially constant inside the indentation. In individual cases it can also be desirable that the curvature is not configured to be constant but in particular runs flat towards the flow outlet side of the propeller nozzle since during assembly the propeller must frequently be inserted from this side into the nozzle and it must be ensured that sufficient space remains in the nozzle for insertion of the propeller.

In particular in this embodiment it is expedient if the indentation is configured as a spherical ball or spherical. This is particularly advantageous in view of the fact that the propeller blades are usually inclined and therefore swivel over a certain length with respect to the indentation.

It is furthermore expedient in this case that the propeller blade end regions have a shape corresponding to the shape of the flow guiding means or the indentation. Accordingly, in this exemplary embodiment the propeller blade end region is to be provided with a spherical shape where the sphere of the propeller blade end region should have the same curvature as the sphere of the indentation so that the gap size remains constant up to a certain predefined pivot angle. If an adjusting propeller is used in the propeller nozzle, the propeller blade end regions or the recesses should be configured to correspond to one another or be matched to one another in such a manner that during adjustment of the propeller blades (adjustment of the angle of incidence), a corresponding configuration is ensured or the gap dimension is constant.

In a further preferred exemplary embodiment, the flow guiding means comprise one or more projection bodies projecting from the inner wall of the nozzle. The projection body or bodies should expediently be disposed in the immediate vicinity of the gap. In particular, the projecting body is at least disposed upstream of the gap when viewed in the flow direction. The one or more projecting bodies are configured in such a manner that they deflect the marginal flow or at least a part of the marginal flow away from the nozzle wall in the direction of the nozzle centre or propeller area. For example, the projection bodies can be configured as a circumferential bulge in the circumferential direction of the nozzle. Such a bulge should be aligned approximately parallel to the gap. In addition, an additional bulge can be disposed downstream of the gap. Alternatively the contour of the nozzle inner wall can run straight or without projection bodies downstream of the gap when viewed in the longitudinal direction of the nozzle. This results in an intensified sealing effect in the sense of a labyrinth seal. The projection bodies can also be provided with a curvature so that the gap remains as constant (small) as possible up to a certain pivot angle when swivelling the nozzle. The configuration of the projection body is preferably adapted to the flow in such a manner that no turbulence or only a small amount of turbulence is produced by the projection body. The projection bodies project into the interior of the nozzle and are configured to guide the marginal flow.

It is particularly preferred that the configuration of the flow guiding means and the configuration of the propeller blade end regions are matched to one another in such a manner that the gap is substantially constant up to a pivot angle of the nozzle of 5°, preferably up to 10°, particularly preferably up to 20°. Expediently all the propeller blades are configured to be the same. In other words, in a predefined pivot angle range the thickness of the gap, i.e. the distance between propeller blade end region and nozzle inner wall remains the same.

The invention is explained in detail hereinafter with reference to several exemplary embodiments shown in the drawings. In the figures, schematically:

Figure 1:
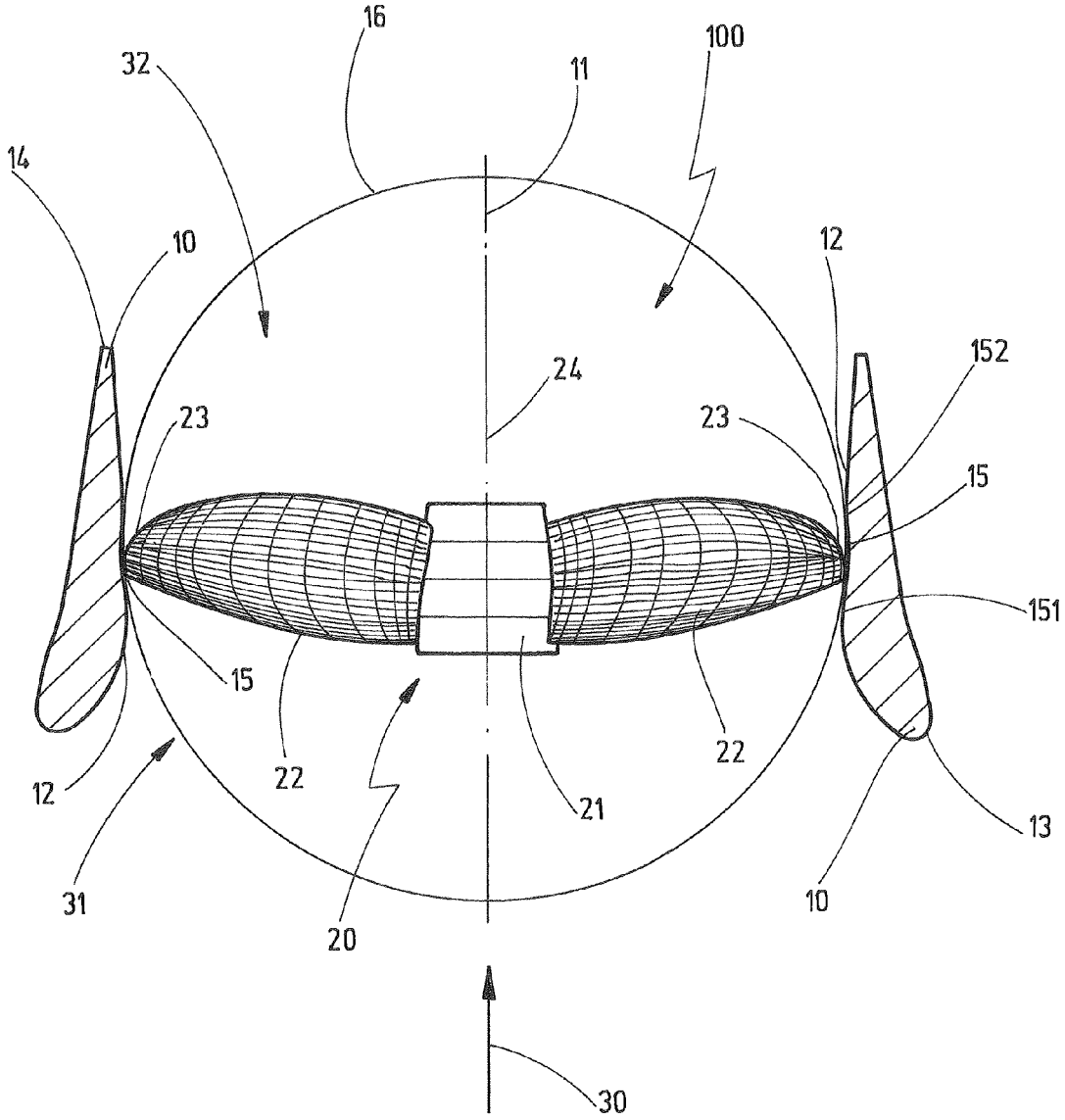
FIG. 1 shows a cutaway view of a pivotable propeller nozzle.
Figure 2:
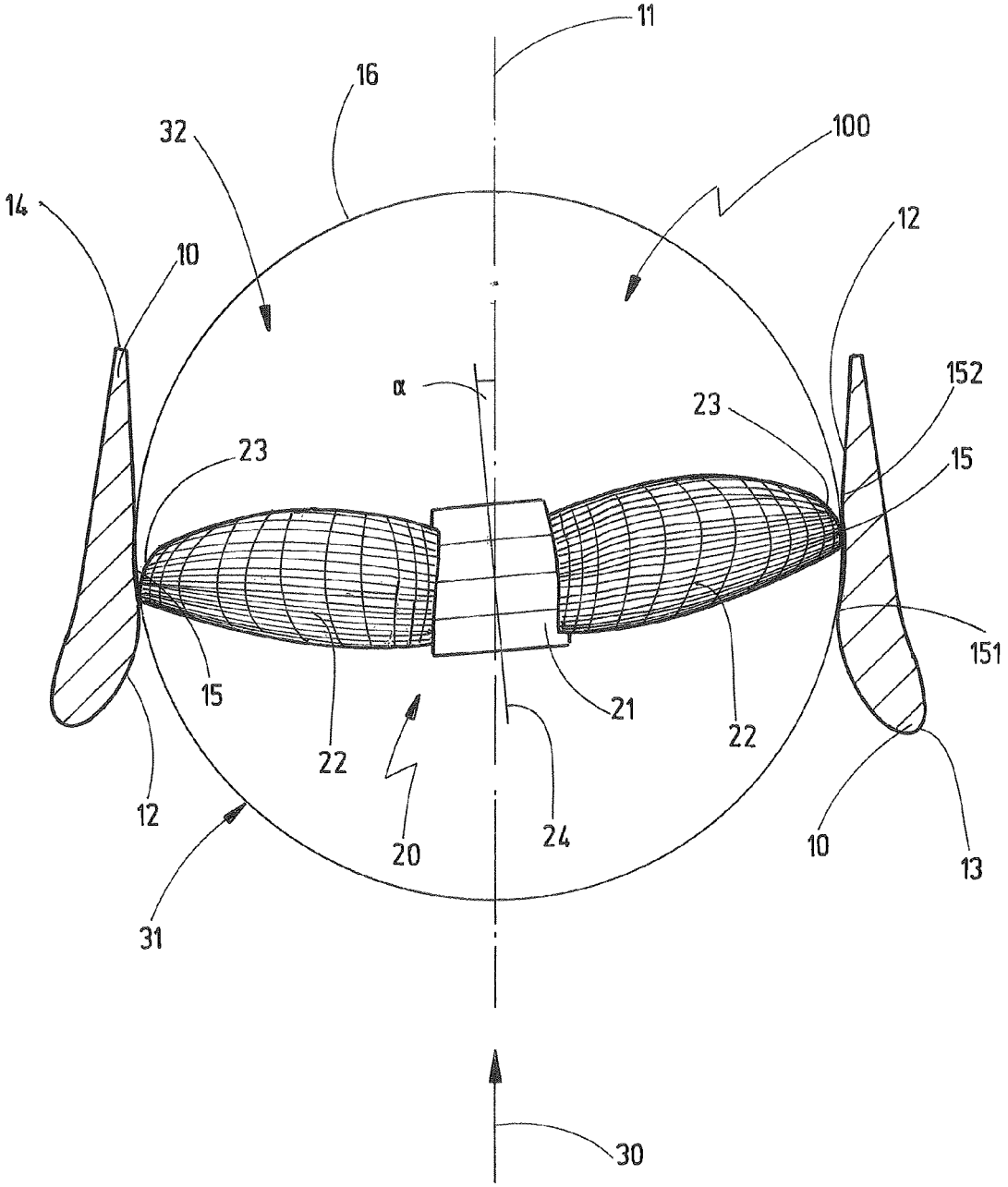
Figure 3:
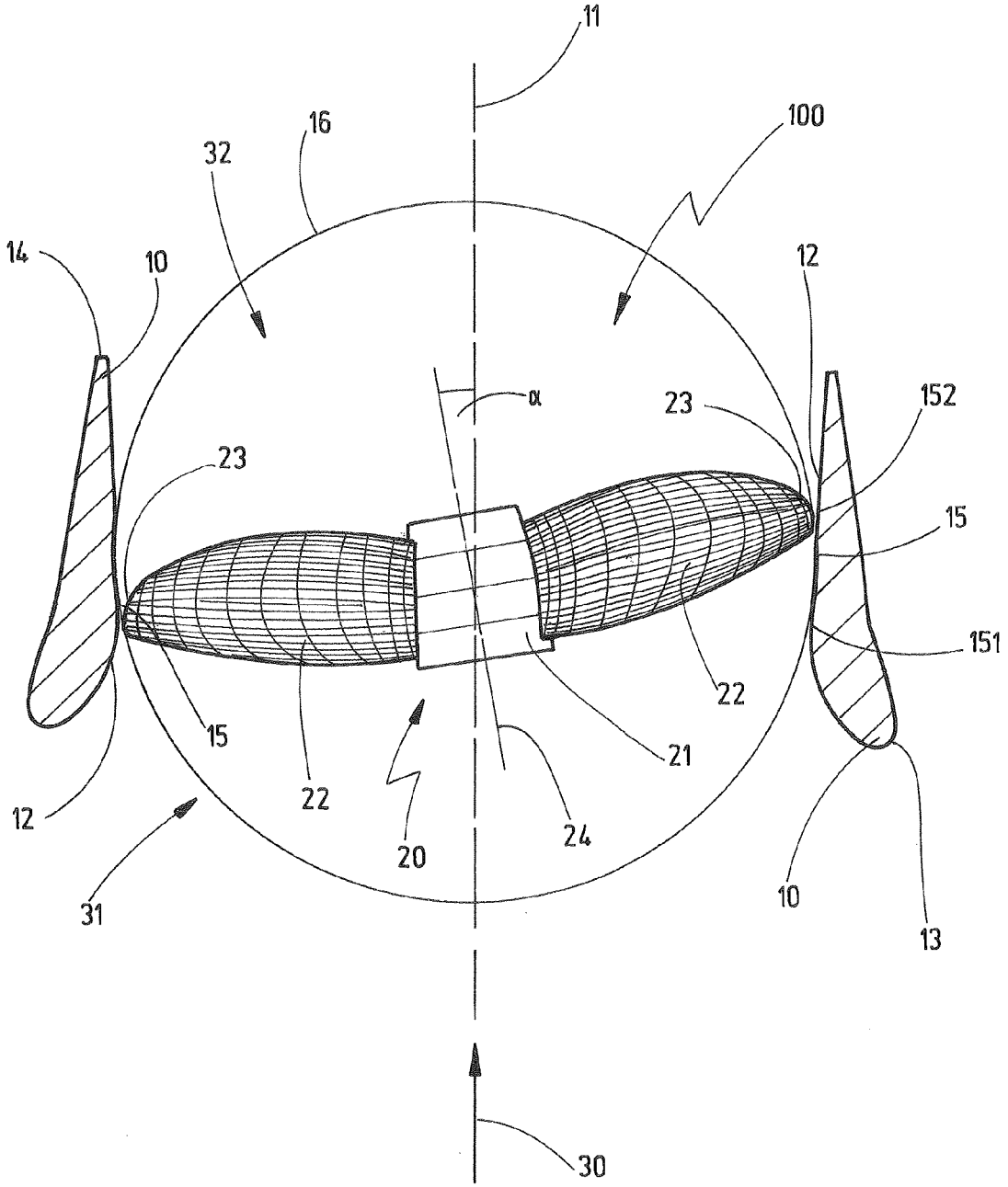
Figure 4:
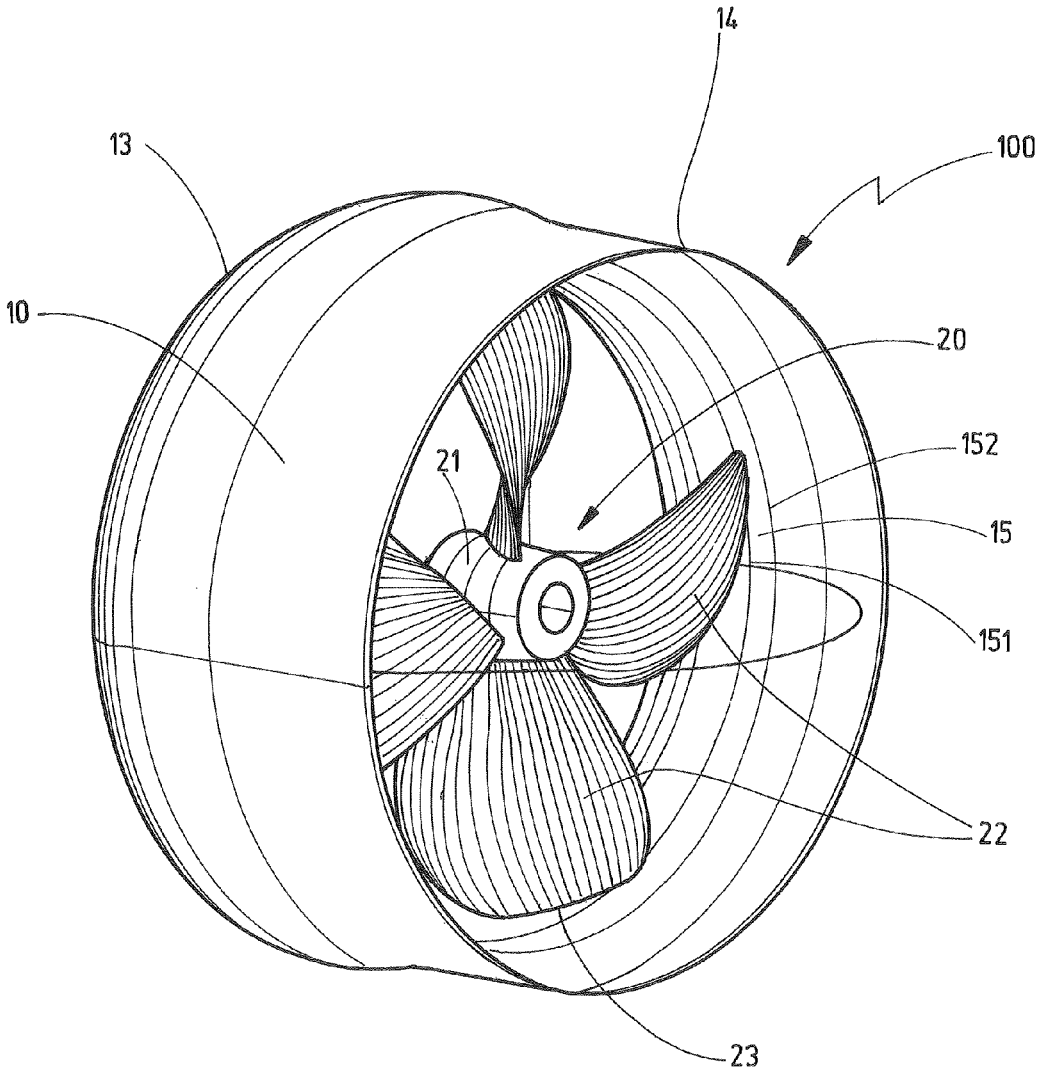
Figure 5:
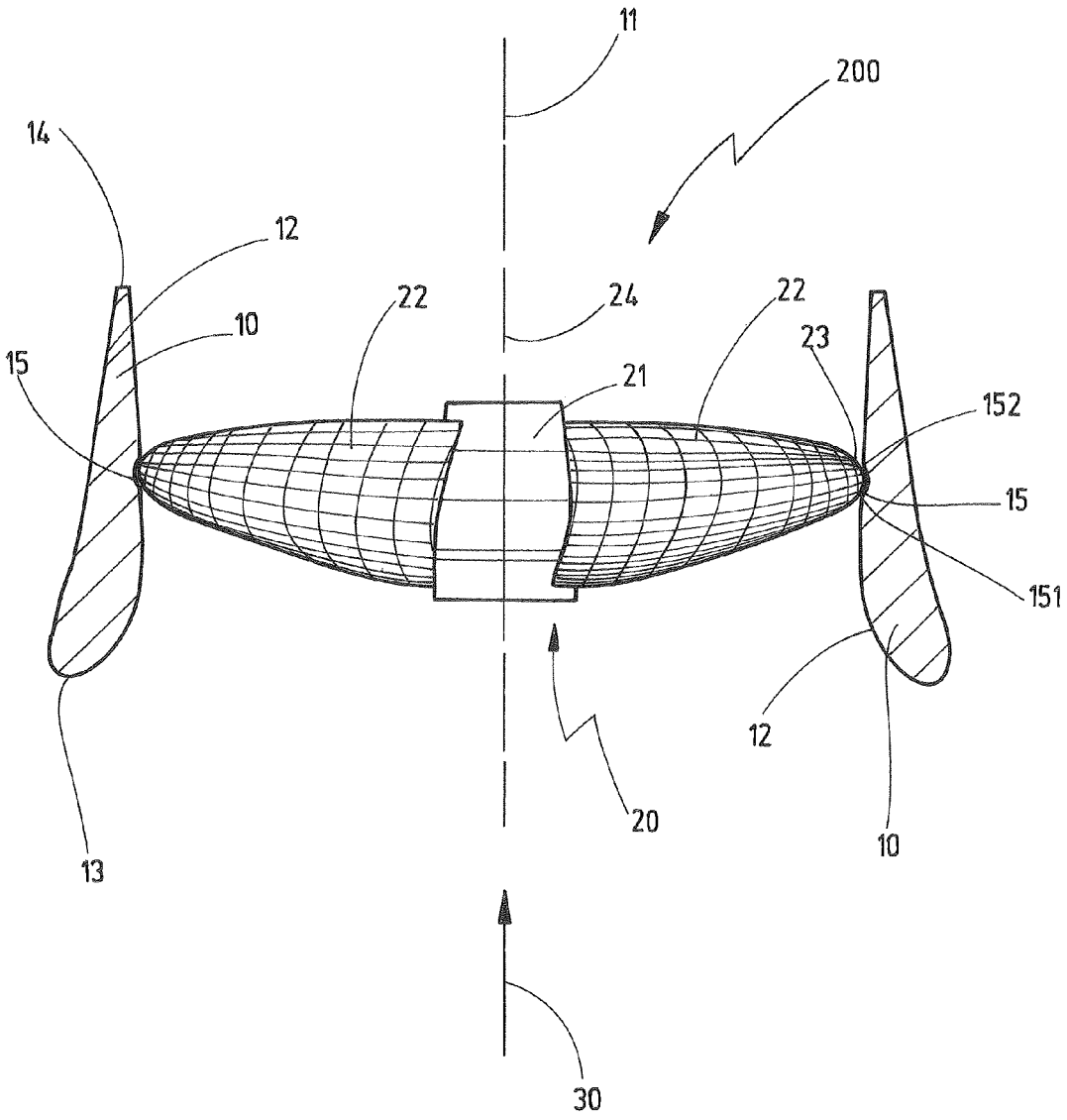
Figure 5A:
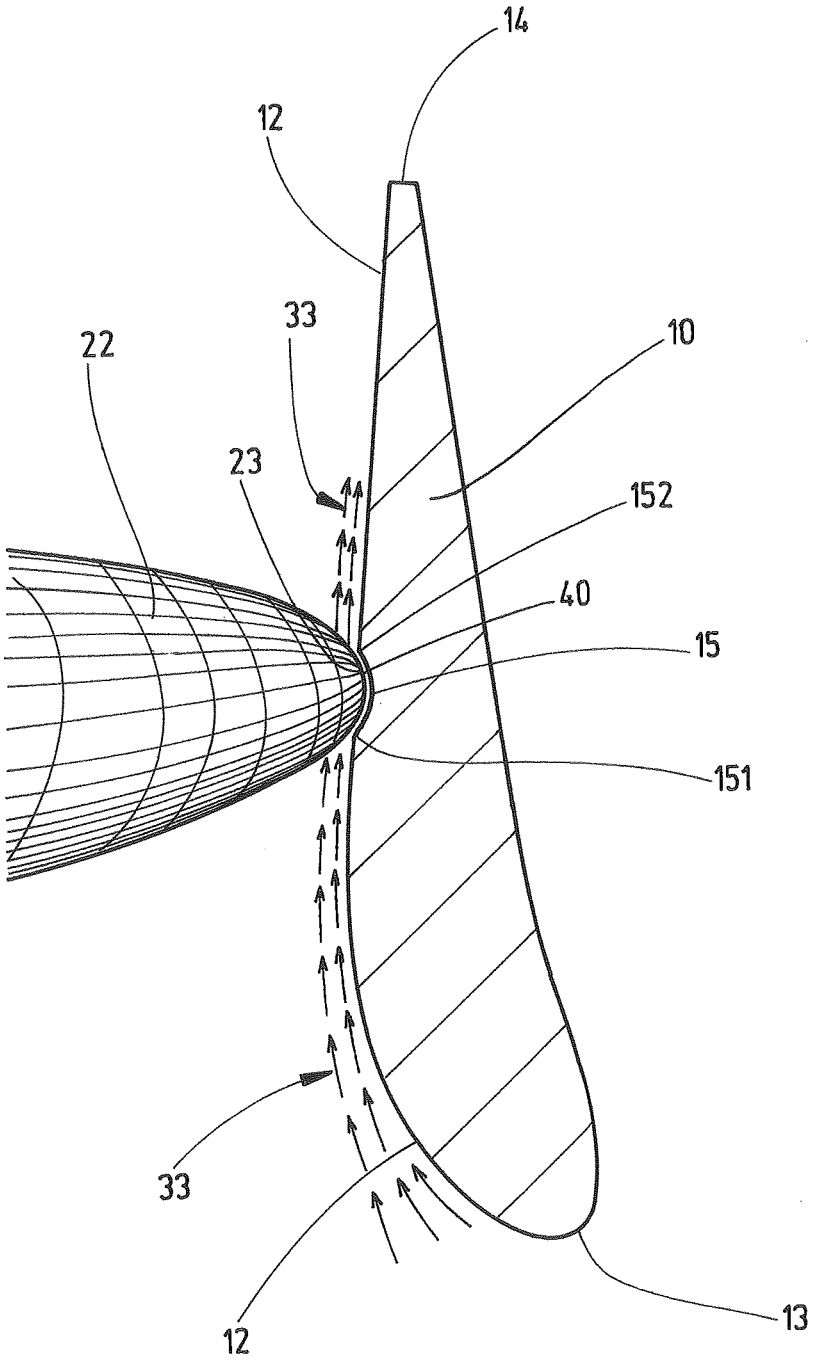
Figure 6:
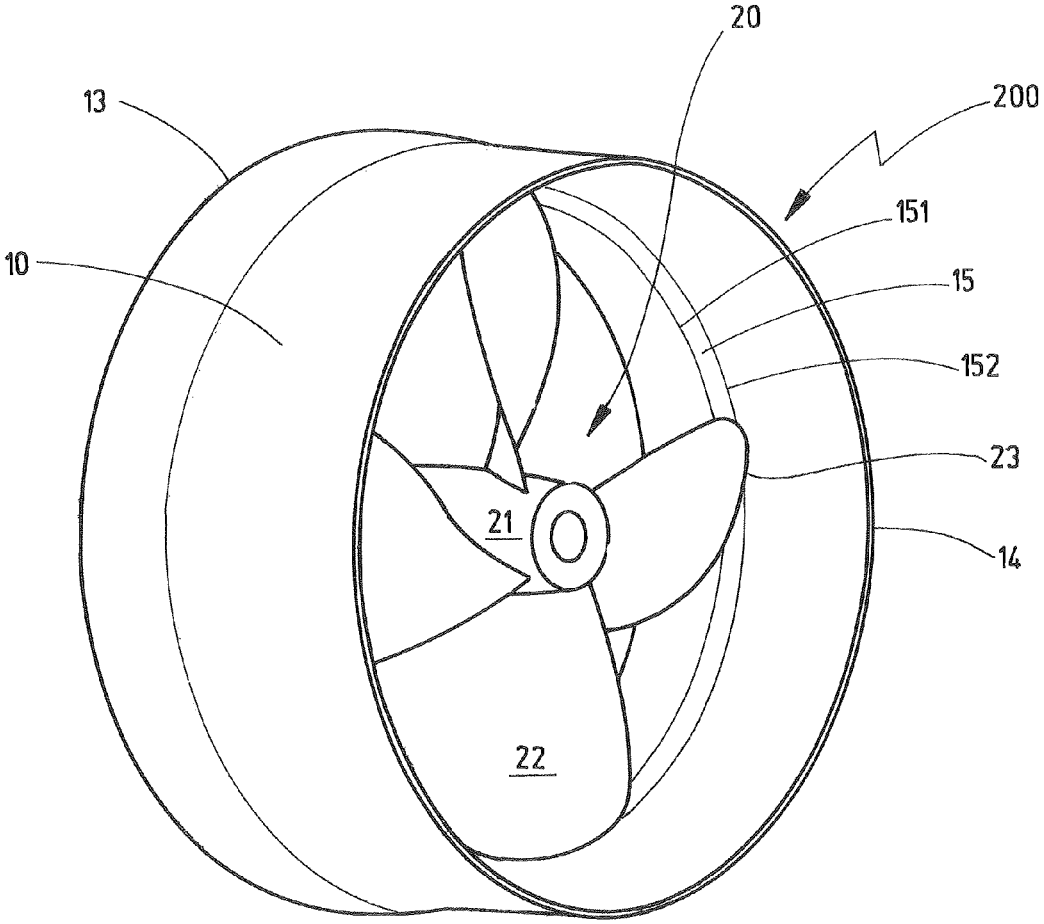
Figure 7A:
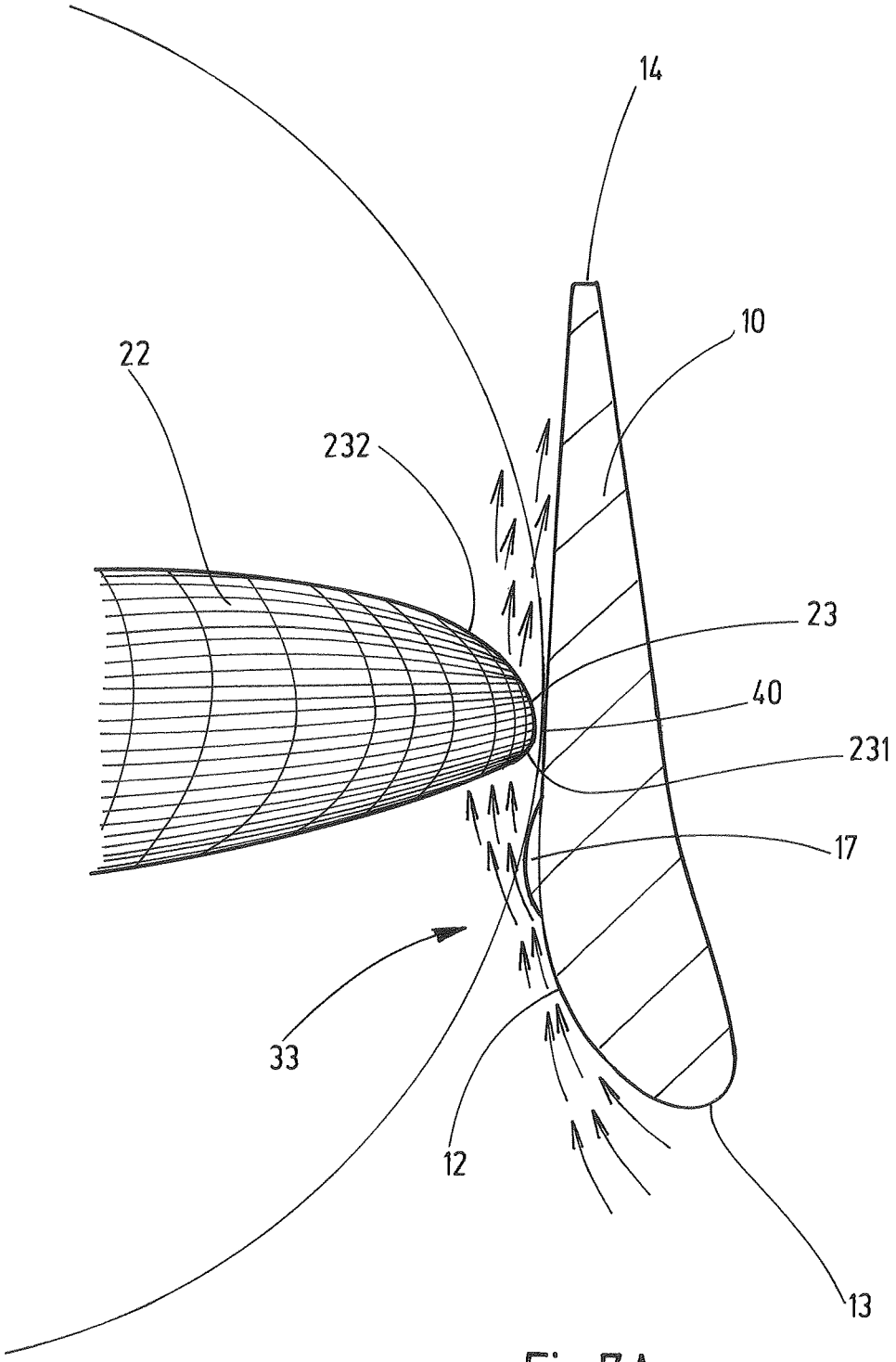
Figure 7B:
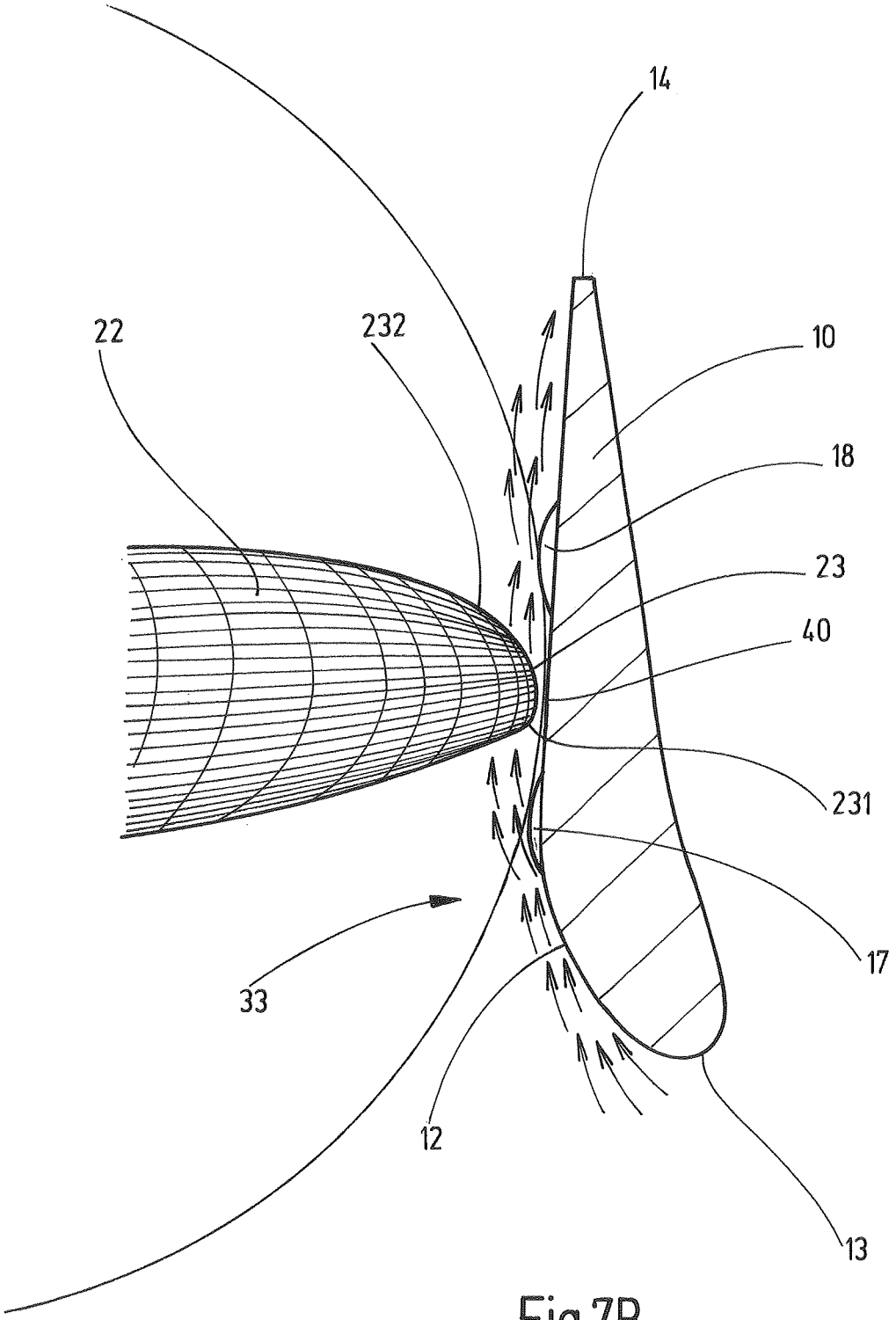
Figure 8A:
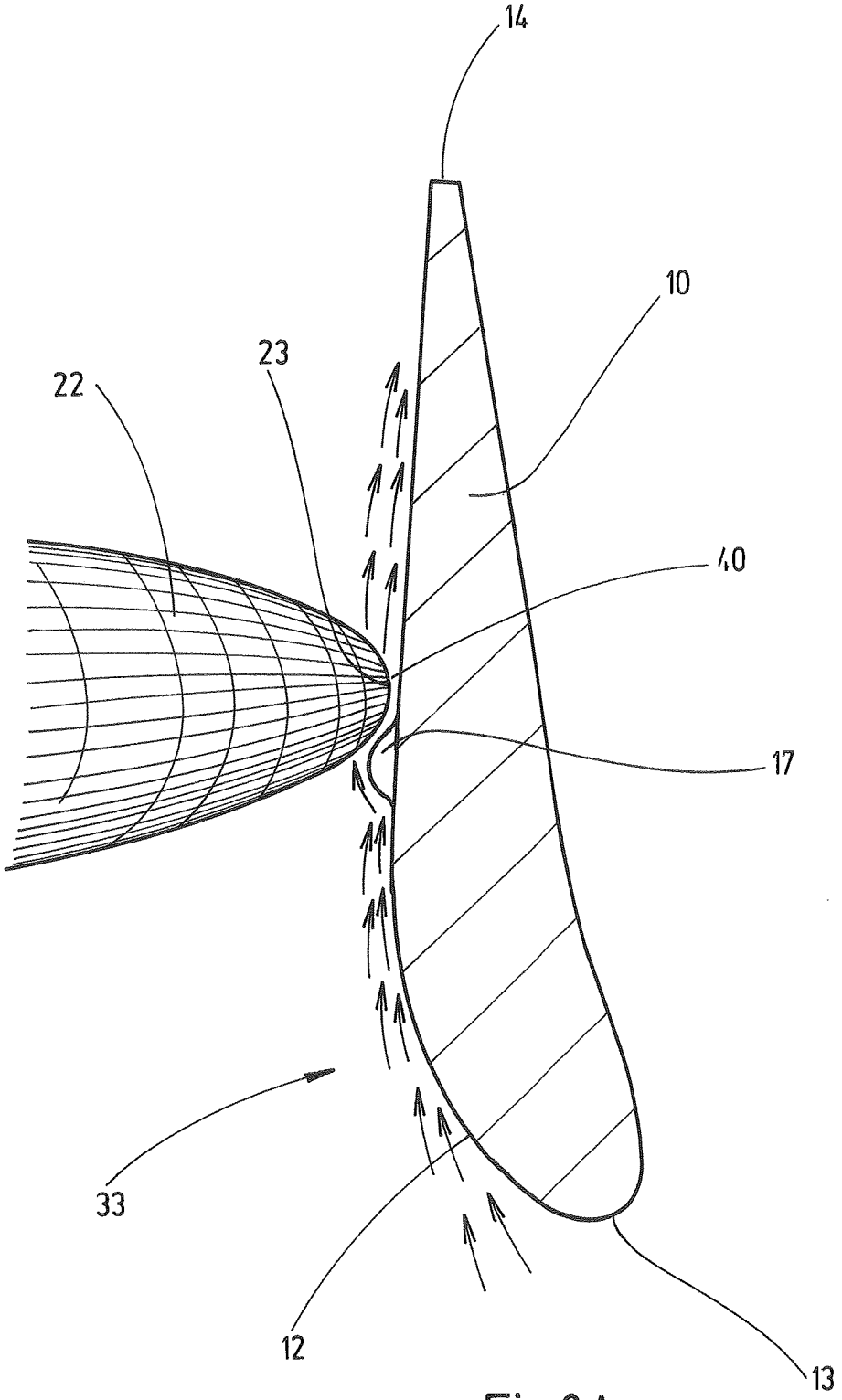
Figure 8B:
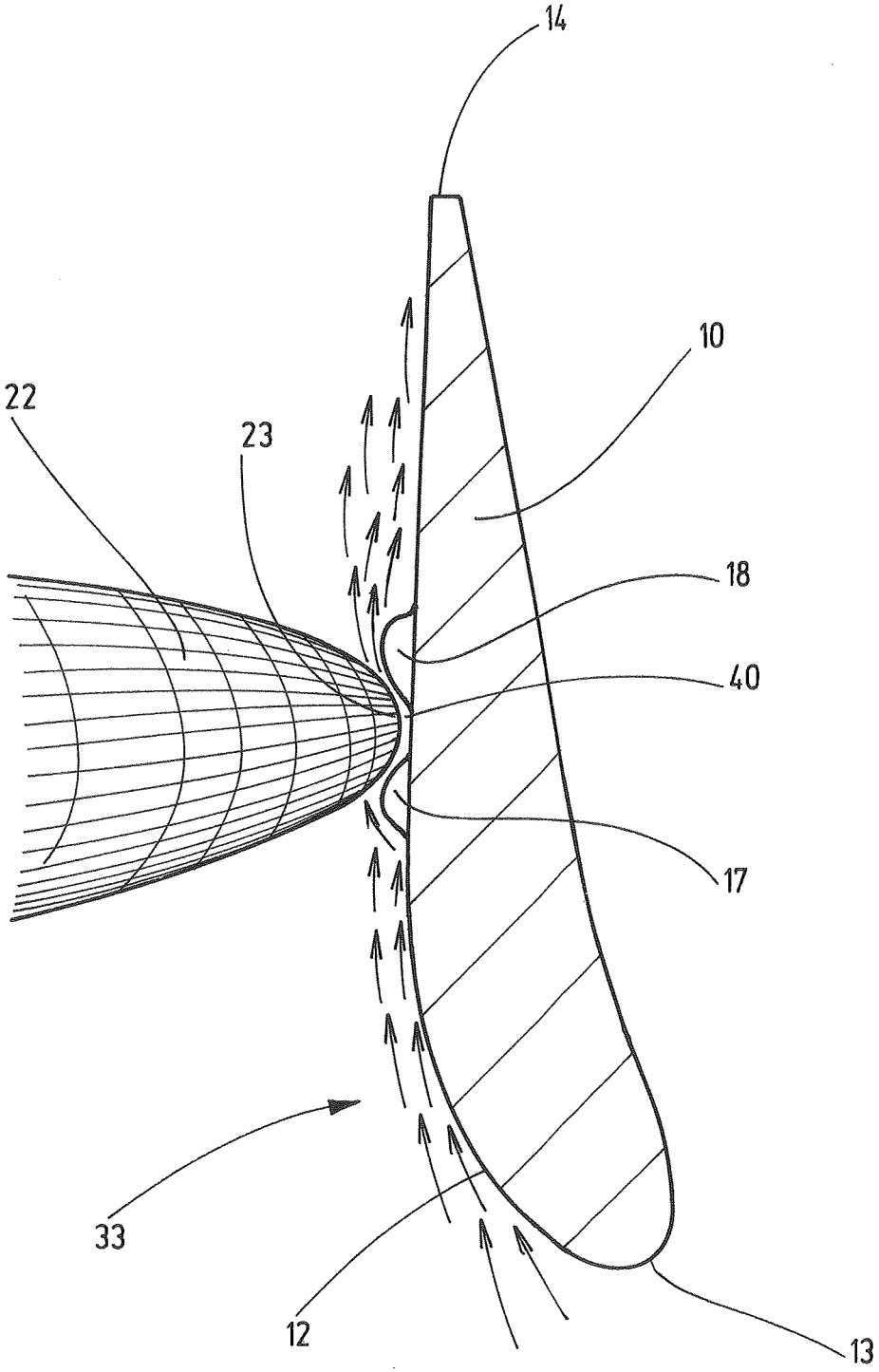

FIG. 2 shows a sectional view of the pivotable propeller nozzle from FIG. 1 with nozzle swivelled by 5°, FIG. 3 shows a sectional view of the pivotable propeller nozzle from FIG. 1 with nozzle swivelled by 10°, FIG. 4 shows a perspective view of the pivotable propeller nozzle from FIGS. 1 to 3, FIG. 5 shows a cutaway view of a non-pivotable propeller nozzle, FIG. 5A shows an enlarged view of a section of the non-pivotable propeller nozzle from FIG. 5, FIG. 6 shows a perspective overall view of the non-pivotable propeller nozzle from FIG. 5, FIG. 7A shows a view of a section of another embodiment of a pivotable propeller nozzle with a front bulge, FIG. 7B shows a view of a section of another embodiment of a pivotable propeller nozzle with a front and a rear bulge, FIG. 8A shows a view of a section of another embodiment of a non-pivotable propeller nozzle with a front bulge, FIG. 8B shows a view of a section of another embodiment of a non-pivotable propeller nozzle with a front and a rear bulge.

In the various embodiments presented in the following the same components are provided with the same reference numbers.

FIGS. 1, 1A, 2, 3 and 4 show a pivotable propeller nozzle 100 in various views. The propeller nozzle 100 comprises a nozzle 10 in the interior whereof a propeller 20 is disposed. The propeller 20 comprises a propeller hub 21 which lies centrally on the propeller axis 24. Four propeller blades 22 project from the propeller hub 21 in the radial direction (see FIG. 4). In the sectional views from FIGS. 1 to 3 only two propeller blades 22 are shown for clarity.

Water flows through the nozzle 10 in the principal direction of flow 30 from the nozzle beginning 13 to the nozzle end 14. In this connection the flow inlet region or the flow outlet region of the nozzle 10 are designated by the reference numbers 31 and 32.

An indentation 15 is disposed on the inner wall 12 of the nozzle 10 approximately at the centre between nozzle beginning 13 and nozzle end 14 when viewed in the principal direction of flow 30. From an indentation beginning 151 the cross-section or the thickness of the nozzle profile is reduced to a lowest point of the indentation 15, from which the cross-section or the thickness of the nozzle 10 increases again as far as an indentation end 152. After the indentation end 152 the inner wall 12 again goes over into the normal nozzle profile. The lowest point of the indentation 15 lies at the centre between the indentation beginning 151 and the indentation end 152. The indentation 15 is configured to be circumferential in the circumferential direction of the nozzle 10 and thus produces an annular groove. The indentation 15 is configured as a circular-arc-shaped profile in the surface of the inner wall 12 of the nozzle 10 and has a relatively flat curvature. As can be identified by the circle 16 indicated in FIGS. 1, 2 and 3, the indentation 15 has a constant curvature over the entire circumference of the nozzle 10.

The individual propeller blades 22 are inclined obliquely in relation to a radial axis. The propeller blade end region 23 i.e. the free end of the propeller blade 22 is also circular-arc-shaped or spherical, where the sphere or the circular arc has the same curvature as the indentation 15 so that the shape of the propeller blade end region 23 corresponds to the shape of the indentation 15. In the side views of FIGS. 1, 1A, 2 and 3 the curvature of the circular arc runs from the beginning 231 of the propeller blade end region 23 to the end 232 of the propeller blade end region 23. Since the propeller blades 22 are twisted or wound into themselves, i.e. about their longitudinal axis, a spherical configuration of the propeller blade end region 23 is obtained.

In FIG. 1 the propeller nozzle 100 is located in the zero position, i.e. it is not swivelled. In a state mounted on a ship, the ship would therefore be travelling straight ahead. Accordingly, the nozzle axis 11, which runs centrally through the nozzle in the longitudinal direction, i.e. in the direction of flow 30, and the propeller axis 24 lie on one another. In the views in FIGS. 2 and 3, the nozzle 10 is in each case swivelled about the propeller axis 24 by a pivot angle $\alpha$. In the view in FIG. 2 the pivot angle $\alpha$ is 5° and in FIG. 3 it is 10°. It can be seen in FIG. 3 that the propeller blade end regions 23 are located opposite the indentation beginning 151 or indentation end 152 with a 10° swivel. That is, when the swivel is over 10°, the propeller blade end regions 23 lie outside the indentation 15. Up to a pivot angle $\alpha$ of 10°, on the other hand, the propeller blade end regions 23 lie inside the indentation 15. As a result of the spherical formation of the indentation 15 and the propeller blade end regions 23 with the same curvature, the distance between propeller blade end region 23 and the inner wall of the nozzle 12 or the thickness of the gap 40 is the same size and unchanged (constant) in each case.

Figure 1A:
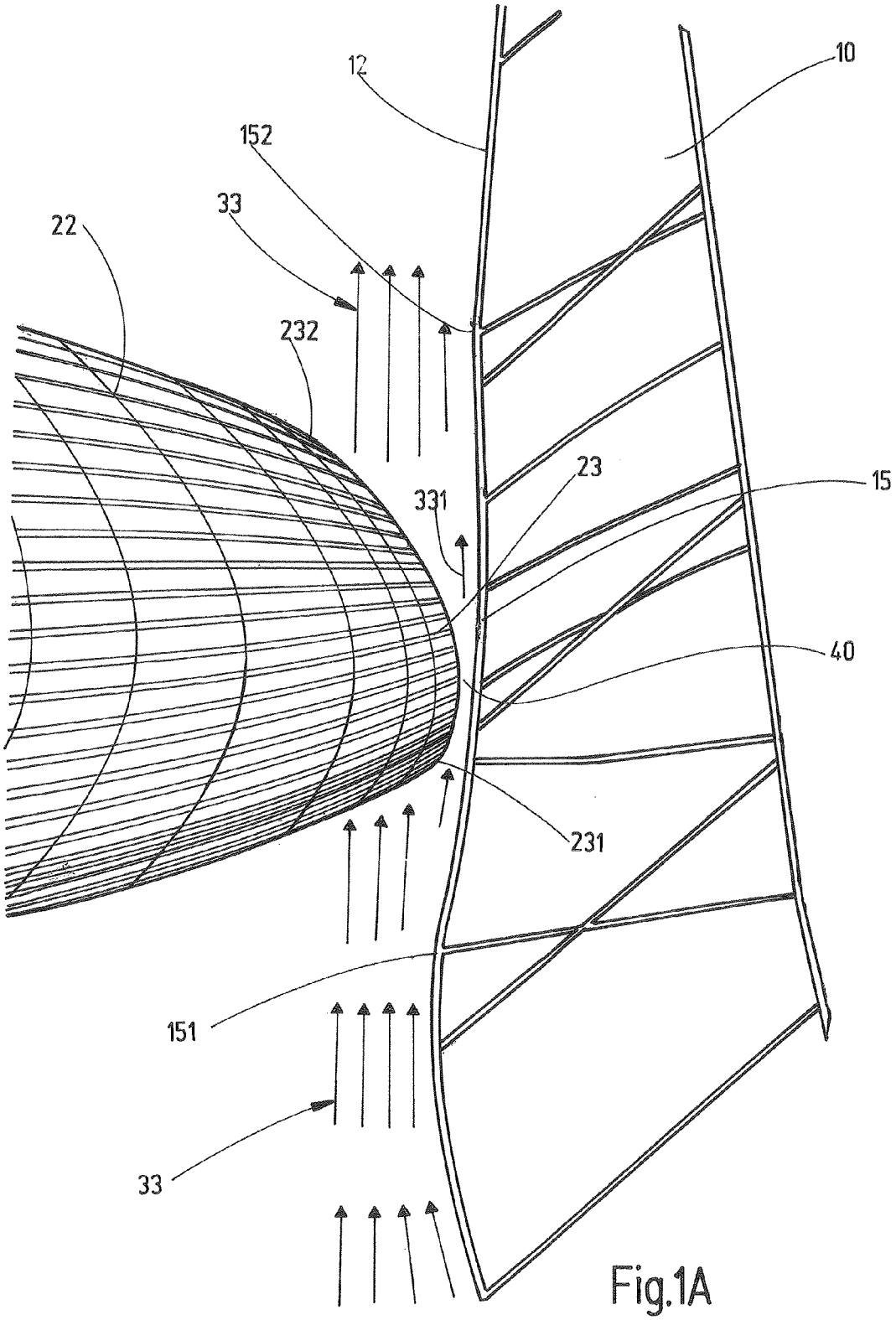
FIG. 1A shows an enlarged view of a section of the diagram from FIG. 1.

In the view in FIG. 1A, arrows provided with the reference number 33 are indicated, which represent the course of the marginal flow. Due to the course of the nozzle inner wall 12 which curves away outwards in the region of the nozzle beginning 13, the flow flows from different directions in the region of the edge, i.e. in the region close to or abutting against the nozzle inner wall 12. In the further course the marginal flow 33 flows along the nozzle wall 12 as far as the indentation beginning 151. The majority of the marginal flow 33 then no longer follows the course of the inner wall 12 into the indentation 15 but flows straight ahead in a laminar fashion and impinges upon the propeller blade 22. Compared with the amount of the marginal flow 33 before the indentation 15, only a severely reduced amount of flow 331 then flows through the gap 40 between propeller blade end region 23 and indentation 15, with the result that the region of the gap 40 is "quasi" sealed. This has the result that less turbulence occurs in the propeller wake. The marginal flow 33 grasped by the propeller blade 22 flows further from the propeller 20 in the direction of the nozzle end 14 either in the region of the main flow in the centre of the nozzle or it abuts against the nozzle inner wall 12 again as marginal flow in the further course of the nozzle 20. This is accomplished substantially after the indentation end 152.

FIGS. 5, 5A and 6 show another embodiment of the invention, namely a non-pivotable propeller nozzle 200. The propeller 20 and the nozzle 10 of the propeller nozzle 200 are configured substantially similarly to the propeller nozzle 100 from FIGS. 1 to 4. in relation to the nozzle 10, one difference is that the indentation 15 in the propeller nozzle 200 has a circular arc-shaped profile but the circular arc profile has a very much greater curvature than that in the propeller nozzle 100. As a result, the indentation 15 viewed in the flow direction 30 is very much shorter, i.e. the distance between indentation beginning 151 and indentation end 152 in the propeller nozzle 200 is very much shorter than in the propeller nozzle 100. This indentation 15 is also configured as a circumferential annular groove (see FIG. 6). The propeller blade end region 23 of the propeller blade 22 has a circular-arc-shaped profile in the views in FIGS. 5 and 5A where the curvature of the circular arc approximately correspond to the profile of the indentation 15, i.e. here also propeller blade end regions 23 and indentation 15 are configured to correspond to one another. Since the nozzle 10 of the propeller nozzle 200 is not swivellable, the propeller blade end region 23 can taper very much more pointedly, i.e. be configured to be narrower than in the propeller blades from the propeller nozzle 100. Similarly as in the propeller nozzle 100, in the propeller nozzle 200 a large part of the marginal flow 33 does not flow through the gap 40 but is grasped in the region of the indentation beginning 151 by the propeller blade 22 (see FIG. 5A).

Both in the propeller nozzle 100 and in the propeller nozzle 200, the propeller blade end regions 23 are introduced deep into the indentation 10 in such a manner that they project outwards over the inner wall region before the indentation beginning 151 or after the indentation end 152. It is thereby possible that the propeller 20 can have a larger diameter for the same nozzle outer dimensions compared with propeller nozzles from the prior art.

FIGS. 7A and 7B show another embodiment of a pivotable propeller nozzle where only a section of a propeller blade 22 and a section through the nozzle 10 are shown. In contrast to the pivotable propeller nozzle from FIGS. 1, 1A, 2, 3 and 4, the pivotable propeller nozzle shown in FIG. 7A is not provided with an indentation in the inner wall 12 of the nozzle 10. Instead, a projection body configured as front bulge 17 is provided upstream of the propeller blade 22 on the nozzle inner wall 12 in the direction of flow. The bulge 17 runs circumferentially in the circumferential direction along the nozzle inner wall 12 and thus forms an annular bulge. In the view in FIG. 7A, the outer edge of the front bulge 17 is approximately arc-shaped. The marginal flow 33 flowing along the nozzle inner wall 12 is deflected by the front bulge 17, at least partially, inwards into the nozzle interior and is thus guided onto the propeller wing 22. Accordingly, the marginal flow 33 is guided at least partially away from the gap 40 between the propeller blade end region 23 and the nozzle inner wall 12. The front propeller blade end region 23 has the same dimensions over its entire circumferential profile.

As a result of the curved configuration of the bulge in the cross-sectional view with constant arc radius, no turbulence or only slight turbulence occurs during deflection of the marginal flow 33. It is also ensured that a swivelling of the propeller 22 is still possible and this is not blocked by the front bulge 17 during the swivelling process, which is indicated by the circle shown in part in FIG. 7A. As a result of this shape of the front bulge 17, the gap 40 between propeller blade end region 23 and nozzle inner wall 12 is as small as possible in all pivot positions between the zero position and the front bulge 17.

The diagram in FIG. 7B shows an embodiment in which compared to the design from FIG. 7A, a rear bulge 18 is provided in a pivotable propeller in addition to the front bulge 17. The rear bulge 18 is disposed downstream of the propeller blade 22 in the direction of flow when the nozzle 10 is not pivoted. The rear bulge 18 is configured to be substantially the same compared with the front bulge 17, i.e. also as a circumferential annular bulge in the circumferential direction. The additional provision of the rear bulge 18 produces an increased sealing effect in the manner of a labyrinth seal.

The diagrams in FIGS. 8A and 8B each show a non-pivotable propeller nozzle where in the diagram in FIG. 8A a front bulge 17 is provided and in the embodiment of FIG. 8A a rear bulge 18 is additionally provided. Since the propeller nozzle is non-pivotable, the bulges 17 or 18 are disposed at a shorter distance from the propeller blade 22 than is the case with the bulges 17, 18 of the pivotable propeller nozzle from FIGS. 7A and 7B. The height of the bulges 17, 18 from FIGS. 8A and 8B is greater than is the case with the bulges 17, 18 from FIGS. 7A and 7B. The outer contour of the bulges 17, 18 from FIGS. 8A, 8B also runs in a curved manner but the degree of curvature is not constant. As a result the shape of the bulges 17, 18 in FIGS. 8A, 8B cannot be adapted to the shape of the propeller blade end region 23 so that a smallest possible gap 40 and therefore a greatest possible sealing effect is obtained. In these embodiments according to FIGS. 8A and 8B the marginal flow 33 is diverted by the front bulge 17 from the nozzle inner wall 12 inwards onto the propeller blade 22.

The invention claimed is:

1. A propeller nozzle, comprising:

a nozzle;

a propeller having at least one propeller blade rotatable about a propeller axis, wherein the at least one propeller blade spans a propeller area through rotation about the propeller axis, the at least one propeller blade comprising a propeller blade end region, wherein the propeller is disposed inside the nozzle in such a manner that a circumferential gap in the circumferential direction of the propeller nozzle is formed between the propeller end region and an inner wall of the nozzle, wherein the gap allows for passage of a marginal flow, said marginal flow flowing in the area of the inner wall of the nozzle; and flow guiding means for guiding at least part of the marginal flow onto the propeller area, wherein the flow guiding means comprise a recess in the inner wall of the nozzle, wherein the recess is configured as an indentation in the inner wall of the nozzle, wherein the propeller end region of the at least one propeller blade has a shape corresponding to a curvature of the flow guiding means, wherein the nozzle is configured to be pivotable about the propeller, wherein the propeller blade end region lies inside the indentation up to a pivot angle of 10°, and wherein the flow guiding means and the propeller blade end region are configured in such a manner and matched to one another so that the gap is substantially constant up to a pivot angle of the nozzle of at least 10°.

2. The propeller nozzle according to claim 1, wherein the flow guiding means are disposed on the inner wall of the nozzle.

3. The propeller nozzle according to claim 1, wherein the flow guiding means are disposed in the immediate vicinity of the gap, in particular in the direction of flow directly upstream of the gap.

4. The propeller nozzle according to claim 3, wherein the flow guiding means are configured to be circumferential in the circumferential direction of the nozzle.

5. The propeller nozzle according to claim 1, wherein the recess has a step-shaped profile, a sloping profile or a curved profile in a longitudinal sectional view of the nozzle.

6. The propeller nozzle according to claim 1, wherein the indentation is configured as a circular arc having the same curvature in a longitudinal sectional view of the nozzle.

7. The propeller nozzle according to claim 6, wherein the indentation is configured to be spherical.

8. The propeller nozzle according to claim 1, wherein the nozzle is configured to be pivotable about the propeller, wherein the flow guiding means and the propeller blade end region are configured in such a manner and matched to one another so that the gap is substantially constant up to a pivot angle of the nozzle of at least 20°.

9. The propeller nozzle according to any one of claims 1-4, wherein the flow guiding means are configured in such a manner that they enable the propeller area to be introduced into the region of the marginal flow.

10. The propeller nozzle according to any one of claims 1-4, wherein the propeller end region is configured to extend into the region of the flow guiding means.

11. The propeller nozzle according to any one of claims 1-4, wherein the flow guiding means are configured in such a manner that they act as a labyrinth seal in cooperation with the propeller blade end region.

* * * * *